US012180725B2

(12) United States Patent
Parsons et al.

(10) Patent No.: US 12,180,725 B2
(45) Date of Patent: Dec. 31, 2024

(54) METHOD OF INSTALLING A BALCONY, AND DEVICE FOR THE SAME

(71) Applicant: SAPPHIRE BALCONIES LIMITED, Reading (GB)

(72) Inventors: Andrew Parsons, Reading (GB); Tim Hill, Reading (GB)

(73) Assignee: Sapphire Balconies Limited, Berkshire (GB)

( * ) Notice: Subject to any disclaimer, the term of this patent is extended or adjusted under 35 U.S.C. 154(b) by 181 days.

(21) Appl. No.: 17/908,374

(22) PCT Filed: Mar. 3, 2020

(86) PCT No.: PCT/EP2020/055584
§ 371 (c)(1),
(2) Date: Aug. 31, 2022

(87) PCT Pub. No.: WO2021/175416
PCT Pub. Date: Sep. 10, 2021

(65) Prior Publication Data
US 2023/0109048 A1 Apr. 6, 2023

(51) Int. Cl.
*E04G 21/18* (2006.01)
*E04B 1/00* (2006.01)

(52) U.S. Cl.
CPC ..... *E04G 21/1841* (2013.01); *E04B 1/003* (2013.01)

(58) Field of Classification Search
CPC ..... E04G 21/1841; E04B 1/003; E04B 1/35; E04B 2001/2409; E04B 1/0038; F05G 2230/604
See application file for complete search history.

(56) References Cited

U.S. PATENT DOCUMENTS

2015/0285225 A1* 10/2015 Ollgaard ..... E04F 19/00 52/745.18
2016/0084221 A1* 3/2016 Moeller ..... F03D 13/10 29/281.1

(Continued)

FOREIGN PATENT DOCUMENTS

CN 207211363 * 4/2018
CN 207211363 U 4/2018

(Continued)

OTHER PUBLICATIONS

International Search Report and Written Opinion, International Application No. PCT/EP2020/055584, European Patent Office International Searching Authority, dated Oct. 30, 2020, 14 pages.

(Continued)

*Primary Examiner* — Theodore V Adamos
(74) *Attorney, Agent, or Firm* — Quarles & Brady LLP

(57) ABSTRACT

A method of securing a balcony to a façade of a building, an activatable balcony fixing, a balcony, and a kit. The method comprising the steps of: aligning the balcony with a projection of the façade, such that an activatable balcony fixing including a shaft, attached to the balcony, is aligned with a socket in the projection; driving the shaft through the socket in the projection, thereby securing the balcony to the façade; and locking the balcony to the façade through one or more further fixings, wherein the shaft and/or the socket in the projection are configured so as to provide tapering engagement between the shaft and the socket.

13 Claims, 4 Drawing Sheets

(56) References Cited

U.S. PATENT DOCUMENTS

| | | | | |
|---|---|---|---|---|
| 2016/0215491 | A1* | 7/2016 | Haughton | E04B 1/003 |
| 2017/0321756 | A1* | 11/2017 | Ollgaard | E04H 12/34 |
| 2019/0003172 | A1* | 1/2019 | Vanker | E04B 1/34 |
| 2019/0218767 | A1* | 7/2019 | Studer | E04B 1/388 |

FOREIGN PATENT DOCUMENTS

| | | | | |
|---|---|---|---|---|
| DE | 19840673 | C1 | | 3/2000 |
| EP | 0614802 | A1 | | 9/1994 |
| EP | 2529908 | A1 | | 12/2012 |
| EP | 3051039 | A1 | * | 8/2016 |
| GB | 2507365 | A | | 4/2014 |
| JP | H10-18411 | A | | 1/1998 |
| JP | 10266332 | A | * | 10/1998 |
| JP | H10-266332 | A | | 10/1998 |

OTHER PUBLICATIONS

International Preliminary Report on Patentability, International Application No. PCT/EP2020/055584, European Patent Office International Searching Authority, dated Sep. 6, 2022, 8 pages.

* cited by examiner

METHOD OF INSTALLING A BALCONY, AND DEVICE FOR THE SAME

RELATED APPLICATIONS

This application is a 35 U.S.C. § 371 national phase application of PCT/EP2020/055584 (WO-2021/175416 A1), filed on Mar. 3, 2020, entitled "METHOD OF INSTALLING A BALCONY, AND DEVICE FOR THE SAME" which is incorporated herein by reference in its entirety.

FIELD OF THE INVENTION

The present invention relates to a method and device for securing a balcony to a façade of a building, and to a balcony including said device.

BACKGROUND

Balconies are often specified in the plans drawn up by architects for new or existing buildings, as a way of increasing the liveable space. These balconies may be decorative, but in many cases they must be structurally secure and capable of supporting the load of several people as well as furniture (balustrades, panels, handrails, etc.) needed to make the balcony safe and usable.

In existing building approaches, a metalworker may attend the site to bolt "stubs" onto/into the concrete frame of a façade of a building while the basic structure of the building is being constructed. At a later stage, often after the main structure of the building, including brickwork and windows is complete, a frame for the balcony is manufactured off site from mild steel, galvanised, and transported to site. The balcony frame is then lifted by crane and held aloft adjacent to the stubs whilst the frame is aligned with the stubs and then bolted onto them by works working underneath or adjacent to the loose balcony.

There are a number of problems with this process.

Firstly, there is a safety risk for the workers who are aligning the balcony and bolting it in place. These workers normally have to either work from an elevated platform (a "cherry picker"), or on a scaffold tower from the ground level or the floor below. There is inevitably a risk of falling associated with working at height. Furthermore, there are risks associated with the manual handling of trying to push the balcony into position, and a risk of trapping hands and figures when trying to get the balcony into position and bolted on. These risks are increase because of the length of time it takes to fix a balcony using this method, as discussed below.

Secondly, it takes a substantial amount of time to install each balcony using this method. The crane has to stay in position supporting the balcony in mid-air while the workers align and bolt the balcony firmly in place. The workers then have to move all their access equipment and tools up to the next floor or balcony location before they can start the installing the next. As a result, the delivery driver also has to stay on site whilst each of the balconies is lifted into position one at a time.

It is also known to provide 'slide-on' balconies, for example as disclosed in GB 2507365 A. Where arms project from the building and the balcony is slid onto them and rests upon them. This allows for operatives to install from inside the building using a guarded door/window opening to access the balcony and guide it into place. However, this method is not usable if the projecting arms clash with façade access equipment, or if there are obstructions such as cladding features which prevent the balcony from being slid into place along the arms.

SUMMARY

Accordingly, and generally, the invention is concerned with providing an activatable balcony fixing including a shaft and a method of using the same, which can provide tapering engagement between a fixing located on both a balcony and a projection of a building, thereby guiding the balcony into a secure position relative thereto.

A first aspect of the present invention provides a method of fixing a balcony to a façade of a building using an activatable balcony fixing including a shaft, the method having the steps of:

- aligning the balcony with a projection of the façade, such that the activatable balcony fixing, attached to the balcony, is aligned with a socket in the projection;
- driving the shaft through the socket in the projection, thereby securing the balcony to the façade; and
- locking the balcony to the façade through one or more further fixings,
- wherein the shaft and/or the socket in the projection are configured so as to provide tapering engagement between the shaft and the socket.

The term 'tapering engagement' is used herein to define that the one or more of the shaft and the socket in the projection (also referred to herein as 'the projection socket') comprises a tapered portion. For example, the shaft may be a tapered shaft (i.e. at least a portion of the shaft may reduce in thickness or diameter along a length of the shaft). Alternatively or additionally, the projection socket may be tapered (i.e. at least a portion of the socket may reduce in diameter along a depth of the socket). In some arrangements, both the shaft and the socket in the projection may comprise a tapered portion.

By providing this tapering engagement between the shaft and the socket, it is possible to fit a balcony to a façade of a building with less exact alignment. By the action of driving the shaft through the socket of the projection the balcony will be further aligned with the projection.

Herein, the projection of the façade may be referred to as a stub.

Optional features of the invention will now be set out. These are applicable singly or in any combination with any aspect of the invention.

The one or more further fixings may be one or more combinations of nuts and bolts, which fix the balcony to the façade. The balcony may have a support beam, which extends in a direction generally aligned with a direction in which the projection projects. The further fixings may fix the support beam to the projection or stub. The stub may be fixed to one or more threaded metal rods embedded in concrete forming the façade. The activatable balcony fixing may be provided on an upper surface of the balcony, i.e. on a surface distalmost from the ground. The activatable balcony fixing may be referred to as a cone.

The balcony may have a surface which is bevelled at an angle greater than 0°. This surface may be that which is closest to the projection when the balcony is aligned with the projection. The surface may be bevelled at an angle of no more than 2°, in some examples it may be bevelled at an angle of 1.6°. This bevelled surface allows for a degree of tolerance as the activatable balcony fixing is activated. The stub or projection may extend no more than 1 metre from the façade, it may extend no more 0.5 metres, or no more than 0.2 metres from the façade.

The activatable balcony fixing may be fixed to the balcony via a clamp or other removable means. The activatable balcony fixing may be fixed to the support beam of the balcony.

The activatable balcony fixing may be remotely activatable. By remotely activatable, it may be meant that an activation mechanism of the activatable balcony is not located in or immediately adjacent to the tapered shaft. For example, the activation mechanism may be located at the end of a cable, or may be wirelessly connected to a user input device.

The shaft may be driven through the socket via an actuator. The actuator may be powered by either electricity or hydraulics or pneumatics. In some arrangements, the shaft may be connected to a mechanism which is operable via a lever in order to move the shaft with respect to the balcony.

The method may include a further step, after securing the balcony to the façade through the one or more further fixing, of removing the activatable balcony fixing from the balcony. As a result, it is possible for a single activatable balcony fixing to be used in the installation of plural balconies. Alternatively, it may be that the activatable balcony fixing forms some part of the ultimate structure of the balcony and so remains installed therein.

The balcony may include a joining plate, to which the activatable balcony fixing is mounted, and which may be positioned so as to overlap a portion of the projection of the façade when the balcony is aligned with the projection. The joining plate may include a socket, and aligning the balcony with the projection may include aligning the socket of the joining plate with the socket of the projection, and the shaft may be driven through the socket of the joining plate and the socket of the projection. Where the joining plate includes a socket, the socket may comprise a tapered portion.

The balcony may include a second activatable balcony fixing including a shaft, which is attached to the balcony at a point distal to the first activatable balcony fixing. In such examples, aligning the balcony may include aligning the second activatable balcony fixing with a second socket of the projection or a second projection, and the method may include driving the shaft of the second activatable balcony fixing through the second socket, wherein the shaft of the second activatable balcony fixing and/or the second socket are configured so as to provide tapering engagement between the shaft of the second activatable balcony fixing ('the second shaft') and the second socket. As discussed above in relation to the first activatable balcony fixing, the second shaft may be a tapered shaft (i.e. at least a portion of the second shaft may reduce in thickness or diameter along a length of the shaft). Alternatively or additionally, the second socket may be tapered (i.e. at least a portion of the second socket may reduce in diameter along a depth of the socket). In some arrangements, both the second shaft and the second socket in the projection may comprise a tapered portion.

In a second aspect, the invention provides an activatable balcony fixing, suitable for securing a balcony to a façade, the fixing comprising:

- a tapered shaft, engageable with a socket in a projection of the façade, said tapered shaft having a narrower end and a wider end, and the shaft being configured to pass through the socket narrow end first;
- an actuator, configured, when activated, to pass the tapered shaft through the socket in the façade; and
- a mount, configured to hold the tapered shaft and actuator to the balcony, such that the tapered shaft is movable with respect to the balcony.

The tapered shaft allows the alignment to be inexact, as by driving the shaft through the socket of the projection the balcony will be further aligned with the projection.

Optional features of the invention will be set out. These are applicable singly, or in any combination with any aspect of the invention.

The actuator may be remotely activatable. By remotely activatable, it may be meant that an activation mechanism of the activatable balcony is not located in or immediately adjacent to the tapered shaft. For example, the activation mechanism may be located at the end of a cable, or may be wirelessly connected to a user input device.

The actuator may be powered by either electricity or hydraulics or pneumatics. Alternatively, the tapered shaft may be connected to a mechanism which is operable via a lever in order to move the tapered shaft with respect to the balcony.

The mount maybe configured to releasably hold the tapered shaft and actuator to the balcony. As a result, it is possible for a single activatable balcony fixing to be used in the installation of plural balconies. Alternatively, it may be that the activatable balcony fixing forms some part of the ultimate structure of the balcony and so remains installed therein.

The balcony may include a joining plate configured, when the fixing is mounted to a balcony, to overlap a portion of the projection of the façade. The joining plate may include a socket, and the tapered shaft may be arranged so as to pass through the socket in the joining plate when securing the balcony to the façade.

In a third aspect, the invention provides a balcony configured to be secured to a façade of a building, the balcony comprising:

- a support beam, suitable for securing to a projection of the façade;
- a joining plate, suitable for bridging a gap between the support beam and the projection, when the balcony is aligned with the projection; and
- an activatable balcony fixing, mounted to the joining plate, and configured to drive a shaft through a socket of the projection, to thereby secure the balcony to the projection of the façade, wherein the shaft and/or the socket in the projection are configured so as to provide tapering engagement between the shaft and the socket.

By providing this tapering engagement between the shaft and the socket, it is possible to fit a balcony to a façade of a building with less exact alignment. By driving the shaft through the socket of the projection the balcony will be further aligned with the projection.

Optional features of the invention will be set out. These are applicable singly, or in any combination with any aspect of the invention.

The activatable balcony fixing may be remotely activatable. By remotely activatable, it may be meant that an activation mechanism of the activatable balcony is not located in or immediately adjacent to the tapered shaft. For example, the activation mechanism may be located at the end of a cable, or may be wirelessly connected to a user input device.

The activatable balcony fixing may include an actuator, configured to drive the tapered shaft through the socket. The actuator may be powered by either electricity or hydraulics or pneumatics. In some arrangements, the tapered shaft may be connected to a mechanism which is operable via a lever in order to move the tapered shaft with respect to the balcony.

The joining plate of the balcony may include a socket, and the activatable balcony fixing may be configured to drive the shaft through the socket in the joining plate when securing the balcony to the projection of the façade. Where the joining plate includes a socket, the socket may comprise a tapered portion.

The balcony may include:

- a second support beam, suitable for securing to the projection or another projection of the façade;
- a second joining plate, suitable for bridging a gap between the second support beam and the projection when the balcony is aligned with the projection; and
- a second activatable balcony fixing, mounted to the second joining plate, and configured to drive a second shaft through a socket of the projection, thereby securing the balcony to the projection of the façade, wherein the second shaft and/or the second socket in the projection are configured so as to provide tapering engagement between the second shaft and the second socket.

In a fourth aspect, the invention provides a kit for securing a balcony to a façade of a building, the kit comprising:

- a balcony, the balcony including a support beam suitable for securing to a projection of the façade, and a joining plate suitable for bridging a gap between the support beam and the projection, when the balcony is aligned with the projection; and
- an activatable balcony fixing, mountable to the joining plate, and configured to drive a tapered shaft through a socket of the projection, to thereby secure the balcony to the projection of the façade, wherein the shaft and/or the socket in the projection are configured so as to provide tapering engagement between the shaft and the socket.

By providing this tapering engagement between the shaft and the socket, it is possible to fit a balcony to a façade of a building with less exact alignment. By driving the shaft through the socket of the projection the balcony will be further aligned with the projection.

Optional features described in relation to the balcony of the third aspect also apply in respect of the balcony forming part of the kit of the fourth aspect.

Optional features described in relation to the activatable balcony fixing of the second aspect also apply in respect of the activatable balcony fixing forming part of the kit of the fourth aspect.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES

Aspects and embodiments of the present invention will now be discussed with reference to the accompanying figures. Further aspects and embodiments will be apparent to those skilled in the art.

Figure 1:
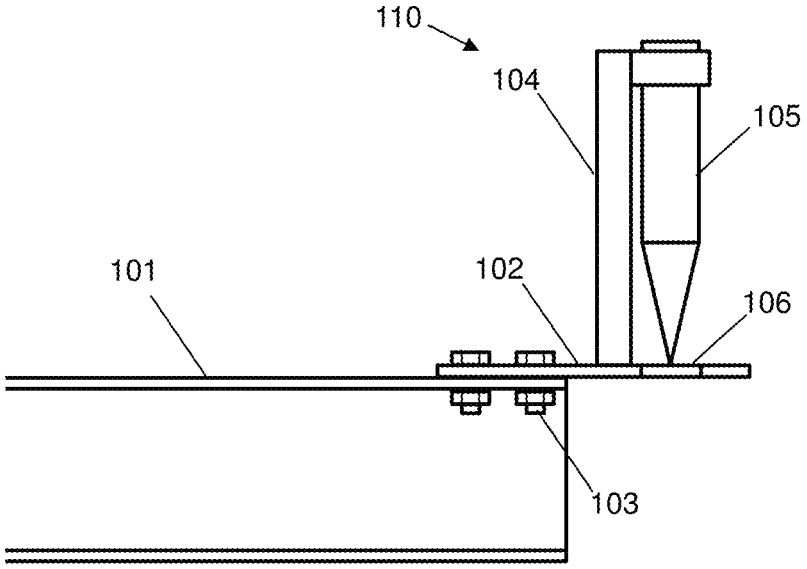
FIG. 1 shows a cross-sectional schematic view of a balcony including an activatable balcony fixing.

FIG. 1 is a cross-sectional schematic view of a balcony including an activatable balcony fixing 110. The balcony includes a support beam 101, for example an I-beam or rolled steel joist (RSJ) formed of galvanised steel, at one end of which are located one or more fittings 103. The fittings connect the support beam to a joining plate 102, on which is fitted the activatable balcony fixing 110. As will be appreciated, the activatable balcony fixing may be directly attached to the support beam 101, i.e. not via joining plate 102—in other words, the joining plate 102 is not an essential feature.

The activatable balcony fixing 110 broadly comprises an actuator 104 and a tapered shaft 105. The actuator 104 is operable so as to move the tapered shaft 105 relative to the support beam 101 of the balcony. In this example, the joining plate 102 includes a socket 106 wide enough to allow the passage of the tapered shaft 105. In other examples, the joining plate 102 may not extend as far from the support beam 101 as a portion of the tapered shaft 105 which is closest to the support beam 101. The end of the support beam 101 may be bevelled, i.e. at an angle relative to the extension of the tapered shaft. This angle may be greater than 0° but less than 2°. In some examples, this angle is around 1.6°. This bevelling allows for a degree of tolerance when fixing the balcony to the façade.

Figure 2:
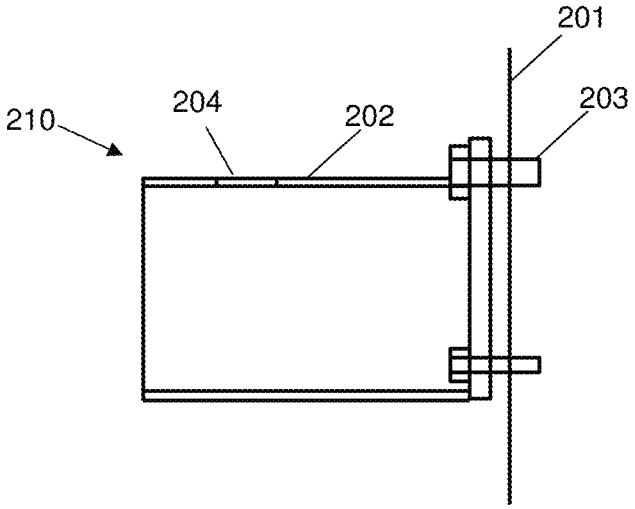
FIG. 2 shows a cross-sectional schematic view of a projection, protruding from a façade of a building.

FIG. 2 is a cross-sectional schematic view of a projection 210, protruding from the façade 201 of a building. The projection 210 is affixed to the façade via one or more fixings 203. In this example, the projection 210 comprises a stub 202, which is formed of a relatively short length of I-beam or RSJ. The projection or stub is generally shorter in length that the support beam 101 of the balcony to which it is to be secured. The projection 210 includes at least one socket 204, which may generally correspond in dimensions to the socket 106 of the joining plate. The fixings 203 may be, for example, one or more threaded metal rods sunk into concrete making up the façade of the building. The stub 202 can then be fitted to these protruding rods through one or more bolts.

Figure 3A:
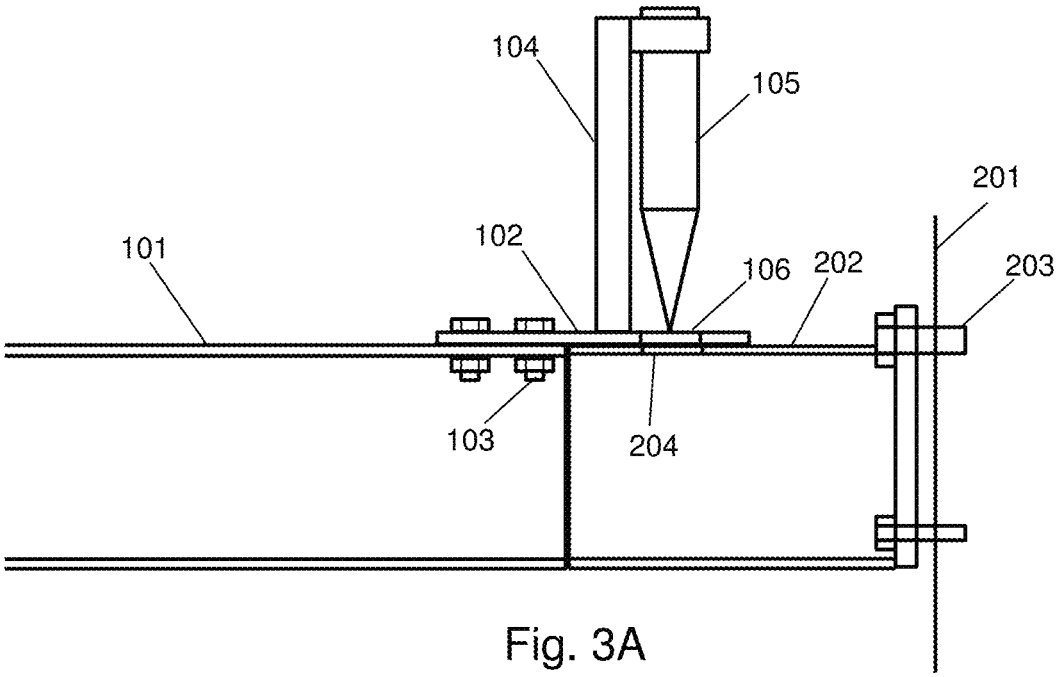
FIGS. 3A and 3B show, respectively, two steps of a method of fixing a balcony to façade of a building.

FIG. 3A shows a first step of a method of attaching the balcony of FIG. 1 to the projection of FIG. 2. Here, the balcony is lifted (for example, via crane) into a position wherein the tapered shaft 105 is generally aligned with the socket 204 of the projection. This can be achieved by bringing the joining plate 102 into an overlapping position with an upper surface of the stub 202. In this example, due to their being an additional socket 106 in the joining plate 102, this means that both sockets are aligned. The balcony is then supported by the crane and retained in this position.

Figure 3B:
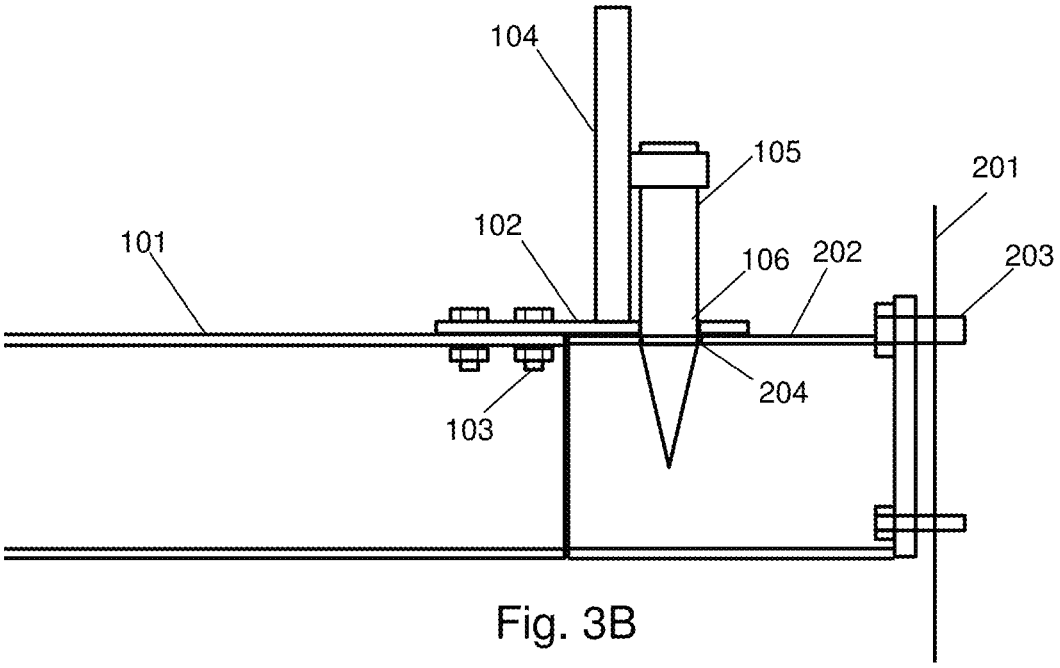

Subsequently, as shown in FIG. 3B, the actuator 104 is activated and the tapered shaft 105 descends through sockets 106 and 204 thereby fixing the support beam 101 of the balcony to the stub 202. The tapered nature of the shaft ensures that the fixing can be achieved when the initial alignment is not exact. As discussed previously, the actuator may be operated remotely such that the risk of trapped hands or fingers during fitting is minimised if not negated entirely.

It will of course be appreciated that the aperture in the socket 106 is optional, in that the joining plate 102 may be configured to not extend over the socket 204 in the stub 202. In such examples, the tapered shaft 105 descents only through the socket 204 in stub 202.

After the step shown in FIG. 3B, operators can safely permanently secure the balcony to the façade through one or more further fixings. During this, the balcony is retained to the façade by the tapered shaft 105.

Figure 4:
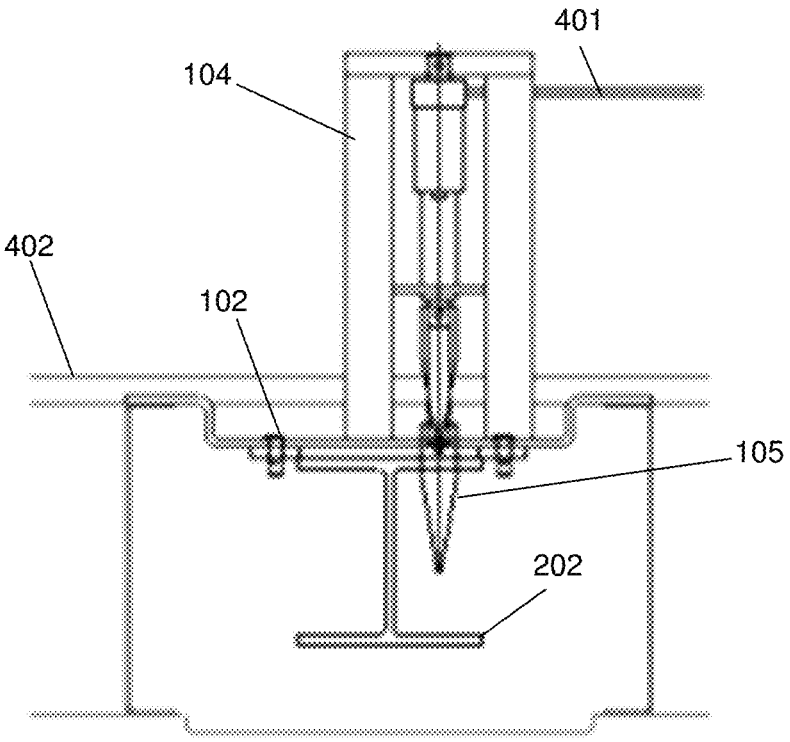
FIG. 4 shows a cross-sectional schematic view of a balcony fixed to a façade of a building, viewed from the building looking out.

FIG. 4 shows a cross-sectional schematic view of a balcony fixed to a façade of a building, viewed from the building looking out. Like features are indicated by like reference numerals. Here the engagement between the stub 202 and the tapered shaft 105 can be better seen, as well as the positioning of the joining plate 102 relative to the stub. Also shown in this figure is cable 401, which connects to actuator 104 and thereby (in this example) facilitates the remote operation of the actuator. Finally, decking or upper panelling 402 can be seen, which will form the upper surface of the balcony when installed. A gap may exist in the upper panelling 402 to allow the operation of the activatable balcony fixing. Once the fixing has been removed, this gap is preferably filled in such that the upper surface of the balcony is generally smooth and uninterrupted.

Figure 5:
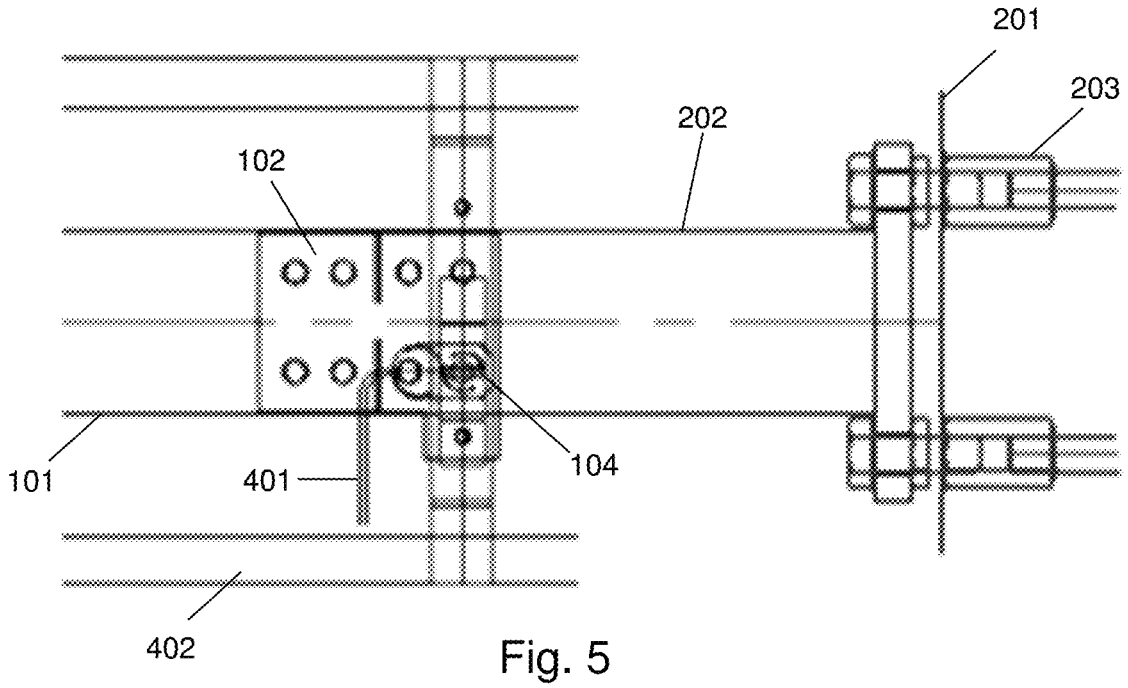
FIG. 5 shows a cross-sectional top-down schematic view of a balcony fixed to a façade of a building.

FIG. 5 shows a cross-sectional top-down schematic view of a balcony fixed to a façade of a building. Like features are indicated by like reference numerals. Here the joining plate 102 can be better seen as spanning the gap between the support beam 101 and the stub 202.

Figure 6:
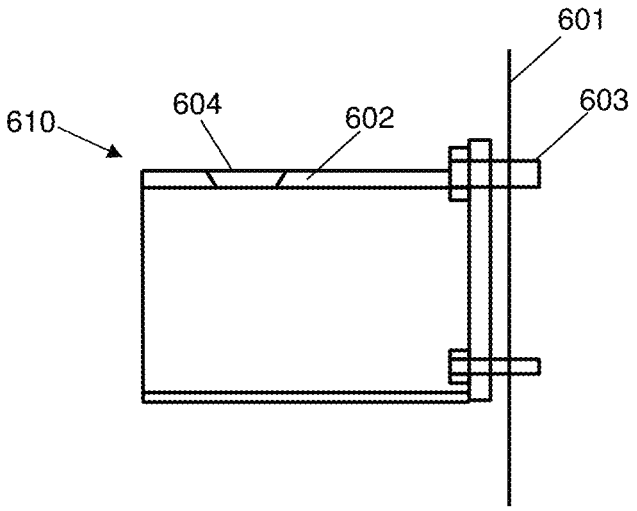
FIG. 6 shows a cross-sectional schematic view of a balcony including an activatable balcony fixing

FIG. 6 shows an alternative projection 610, protruding from the façade 601 of a building. The projection 610 is affixed to the façade via one or more fixings 603. In this example, the projection 610 comprises a stub 602, which is formed of a relatively short length of I-beam or RSJ. The projection 610 includes at least one socket 604. Here, the socket 604 is tapered, i.e. it decreases in diameter along the depth of the socket. In this way, the socket in the projection is configured so as to provide tapering engagement between the shaft and the socket. By the action of driving a shaft through the socket of the projection the balcony will be further aligned with the projection.

Figure 7A:
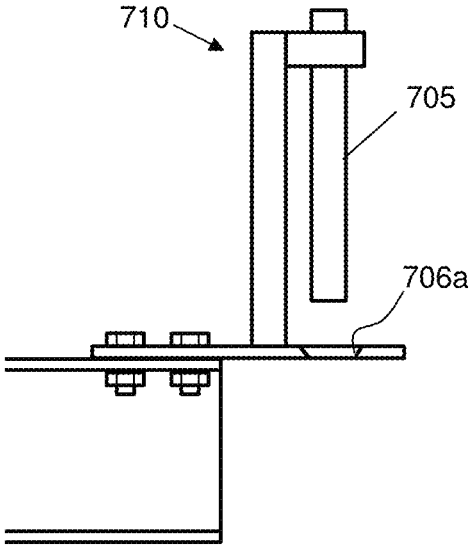
FIG. 7 shows a cross-sectional schematic view of a balcony including an activatable balcony fixing
Figure 7B:
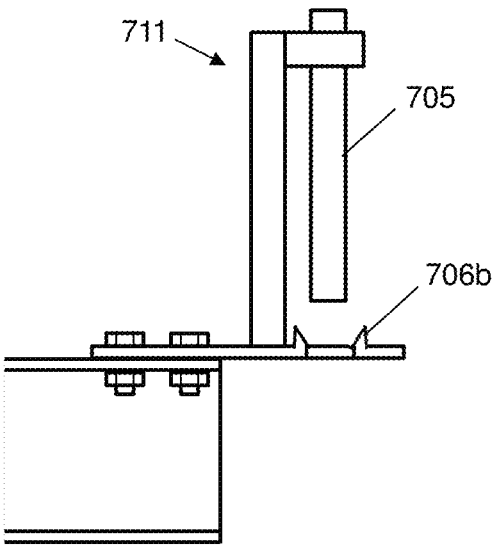

FIGS. 7A and 7B show cross-sectional schematic views of balconies including activatable balcony fixings 710, 711. These are substantially similar to the activatable balcony fixing 110 described in relation to FIG. 1, except that the shaft 705 is not a tapered shaft. The shaft is a straight shaft (optionally also referred to as a rod). Furthermore, the joining plate includes a socket 706*a*, 706*b* having a tapered portion to thereby allow for tapering engagement between the shaft and the joining plate. In FIG. 7A, the entire socket is tapered in a depth direction. In the arrangement shown in FIG. 7B, the socket comprises an upstanding tapered guiding part.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A balcony configured to be secured to a façade of a building, the balcony comprising:

a support beam, suitable for securing to a projection of the façade;

a joining plate, suitable for bridging a gap between the support beam and the projection, when the balcony is aligned with the projection; and an activatable balcony fixing including a shaft and an actuator, mounted to the joining plate, and configured to move the shaft relative to the balcony to drive the shaft through a socket of the projection by operation of the actuator, to thereby secure the balcony to the projection of the façade, wherein the shaft and/or the socket in the projection are configured so as to provide tapering engagement between the shaft and the socket, wherein the activatable balcony fixing is configured to be removable from the balcony, after locking the balcony to the façade through one or more further fixings, and wherein the activatable balcony fixing is configured to support and hold the balcony in place by itself when the balcony is secured to the façade through the activatable balcony fixing.

2. The balcony of claim 1, wherein the activatable balcony fixing is remotely activatable.

3. The balcony of claim 1, wherein the actuator is powered by either electricity or hydraulics or pneumatics.

4. The balcony of claim 1, wherein the joining plate includes a socket, and the activatable balcony fixing is configured to drive the shaft through the socket in the joining plate when securing the balcony to the projection of the façade.

5. The balcony of claim 1, further comprising:

a second support beam, suitable for securing to the projection or another projection of the façade;

a second joining plate, suitable for bridging a gap between the second support beam and the projection or another projection when the balcony is aligned with the projection or another projection; and a second activatable balcony fixing, mounted to the second joining plate, and configured to drive a second shaft through a second socket of the projection or another projection, thereby securing the balcony to the projection or another projection of the façade, wherein the second shaft and/or the second socket in the projection or another projection are configured so as to provide tapering engagement between the second shaft and the second socket.

6. A kit for securing a balcony to a façade of a building, the kit comprising:

a balcony, the balcony including a support beam suitable for securing to a projection of the façade, and a joining plate suitable for bridging a gap between the support beam and the projection, when the balcony is aligned with the projection; and an activatable balcony fixing including a shaft and an actuator, mountable to the joining plate, and configured to move the shaft relative to the balcony to drive the shaft through a socket of the projection by operation of the actuator, to thereby secure the balcony to the projection of the façade, wherein the shaft and/or the socket in the projection are configured so as to provide tapering engagement between the shaft and the socket, wherein the activatable balcony fixing is configured to be removable from the balcony, after locking the balcony to the façade through one or more further fixings, and wherein the activatable balcony fixing is configured to support and hold the balcony in place by itself when the balcony is secured to the façade through the activatable balcony fixing.

7. A method of securing a balcony to a façade of a building using an activatable balcony fixing including a shaft and an actuator, the method having the steps of:

aligning the balcony with a projection of the façade, such that the activatable balcony fixing including the shaft, attached to the balcony, is aligned with a socket in the projection;

operating the actuator to move the shaft relative to the balcony to drive the shaft through the socket in the projection, thereby securing the balcony to the façade;

locking the balcony to the façade through one or more further fixings; and after locking the balcony to the façade through the one or more further fixings, removing the activatable balcony fixing from the balcony;

wherein the shaft and/or the socket in the projection are configured so as to provide tapering engagement between the shaft and the socket, and wherein the activatable balcony fixing is configured to support and hold the balcony in place by itself when the balcony is secured to the façade through the activatable balcony fixing.

8. The method of claim 7, wherein the activatable balcony fixing is remotely activatable.

9. The method of claim 7, wherein the actuator is powered by either electricity or hydraulics or pneumatics.

10. The method of claim 7, wherein the balcony includes a joining plate, to which the activatable balcony fixing is mounted, and which is positioned so as to overlap a portion of the projection of the façade when the balcony is aligned with the projection.

11. The method of claim 10, wherein the joining plate includes a socket, and wherein aligning the balcony with the projection includes aligning the socket of the joining plate with the socket of the projection, and wherein the shaft is driven through the socket of the joining plate and the socket of the projection.

12. The method of claim 7, wherein the balcony includes a second activatable balcony fixing including a shaft, which is attached to the balcony at a point distal to the first activatable balcony fixing.

13. The method of claim 12, wherein aligning the balcony includes aligning the second activatable balcony fixing with a second socket in the projection or a second projection, and the method includes driving the shaft of the second activatable balcony fixing through the second socket, wherein the shaft of the second activatable balcony fixing and/or the second socket are configured so as to provide tapering engagement between the shaft of the second activatable balcony fixing and the second socket.

* * * * *